US007629749B2

(12) United States Patent
Aurongzeb

(10) Patent No.: US 7,629,749 B2
(45) Date of Patent: Dec. 8, 2009

(54) QUARTZ METAL HALIDE LAMP WITH IMPROVED STRUCTURAL AND ELECTRICAL PROPERTIES

(75) Inventor: Deeder Aurongzeb, Mayfield Heights, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 11/598,532

(22) Filed: Nov. 13, 2006

(65) Prior Publication Data

US 2008/0111488 A1 May 15, 2008

(51) Int. Cl.
*H01J 17/20* (2006.01)
*H01J 7/24* (2006.01)
*H01J 61/82* (2006.01)

(52) U.S. Cl. ..... 313/623; 313/541; 313/637; 439/615

(58) Field of Classification Search ..... 313/600–607
See application file for complete search history.

(56) References Cited

U.S. PATENT DOCUMENTS

| | | | | |
|---|---|---|---|---|
| 5,527,199 | A * | 6/1996 | Feder et al. | 445/49 |
| 6,815,892 | B2 * | 11/2004 | Morimoto et al. | 313/633 |
| 2003/0168980 | A1 * | 9/2003 | Hataoka et al. | 313/623 |
| 2004/0124759 | A1 * | 7/2004 | Emilsson | 313/491 |
| 2004/0256986 | A1 * | 12/2004 | Graf et al. | 313/558 |

* cited by examiner

*Primary Examiner*—Sikha Roy
*Assistant Examiner*—Tracie Green
(74) *Attorney, Agent, or Firm*—Fay Sharpe LLP

(57) ABSTRACT

The invention relates to a discharge lamp having and envelope and at least one pair of inner leads and at least one pair of outer leads corresponding thereto, at least one end of each lead disposed in the interior of the lamp, with a substantially planar foil between any one pair of inner and outer leads, and a connector provided between any one lead and the foil, the connector having at least one planar contact surface for connecting the lead to the foil and increasing the contact surface area and providing means for dissipating excess heat and energy that enters the lamp.

19 Claims, 4 Drawing Sheets
(1 of 4 Drawing Sheet(s) Filed in Color)

QUARTZ METAL HALIDE LAMP WITH IMPROVED STRUCTURAL AND ELECTRICAL PROPERTIES

BACKGROUND OF THE INVENTION

The present disclosure relates to high intensity electric discharge lamps. It finds particular application in those instances where the lamp is subject to uncontrolled increases and decreases in wattage and therefore temperature over a short period of time, which can result in lamp failure due to failure of weld joints and other sensitive features under such power cycling circumstances. However, it is to be appreciated that the present disclosure will have wide application throughout the lighting industry.

Lamps for which the present disclosure may prove suitable include any lamp characterized by the inclusion of a discharge envelope of fused silica containing a discharge-supporting filling of gas or vapor, for example. The lamp usually includes at least one pair of electrodes with gap>3 mm between which an electric discharge passes in operation of the lamp. An electric current is supplied to the electrodes from a source exterior to the lamp envelope via what is commonly called a ribbon seal. This seal generally comprises a strip of refractory metal foil, commonly of molybdenum, having one end thereof electrically connected to a respective electrode, and the opposite end in electrical contact with a refractory metal rod which passes through the end wall of the envelope to provide an external lead. The foil, electrodes, and lead rods are embedded in the fused silica envelope wall.

In order to stabilize the foil-electrode-lead rod assembly during manufacture and use, it has been suggested that portions of the assembly be wrapped in a coil of refractory metal wire, such as for instance tungsten. The assembly passes through a segment of the envelope which is pinched during manufacture to provide support for the assembly. However, during fusing of the pinched silica portion of the envelope, it is difficult to maintain the integrity of the assembly without damaging the foil, electrodes and/or lead rods. The addition of a coil provides a means to strengthen the assembly and to absorb some of the heat generated during fusing of the envelope, because the fused silica can collapse around the coil during the pinching process without jeopardizing directly the assembly components.

While the foregoing coil, which is set forth completely in U.S. Pat. No. 4,550,269, to our common assignee, achieves the goal of providing support for the assembly and dissipating some heat, a continuing problem remains with regard to integrity of the assembly during repeated power cycling at levels above and below those for which the lamp is stabilized. This can occur in some electric systems which are not well regulated for total wattage or energy supply. A certain consequence to the lamp of experiencing this type of power cycling and temperature fluctuation is degradation of the welds applied to connect the assembly components, which then necessarily leads to lamp failure as the connections are compromised.

The invention disclosed herein is intended to provide a lamp assembly which addresses the foregoing concerns by providing a connector to improve the connection between any one lead and the foil. The connector contemplated herein, due to its configuration, allows an increased surface area at the point of contact between the lead and the foil, thus strengthening the weld at that point. The connector further provides a means for dissipating heat and energy build up at the weld joint. This results in improved thermal and electrical performance of the lamp, regardless of cycling of the exterior power source, or other difficult operational parameters.

BRIEF DESCRIPTION OF THE INVENTION

A discharge lamp is provided. The lamp includes an improved connection between the foil and leads, whether outer lead rods or electrodes, thus stabilizing the entire assembly. The improved connection is provided by the addition of a connector which fits intimately over the lead end and has a geometric shape providing at least one planar surface. The planar connector surface can be up to as wide as the foil that it connects with, thus increasing the surface area of the connection. Additionally, a film of heat absorptive material can be coated over the connector to dissipate and reduce resistive heating which is detrimental to lamp performance and life. Further, the thermal properties of the connector material improve the capability of the connector to absorb excessive heat generated during either manufacture or performance before the lamp integrity is compromised.

BRIEF DESCRIPTION OF THE DRAWINGS

The patent or application file contains at least one drawing executed in color. Copies of this patent with color drawings will be provided by the Patent and Trademark Office upon request and payment of the necessary fee.

DETAILED DESCRIPTION OF THE INVENTION

Figure 1:
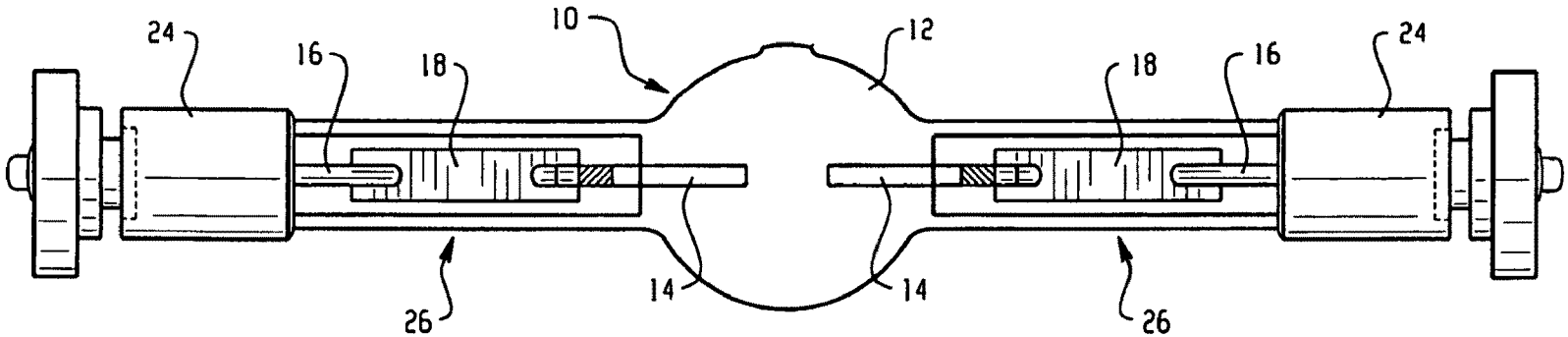
FIG. 1 shows diagrammatically, and partially in section, a discharge lamp according to the present invention.

With reference to FIG. 1, there is shown a representative high intensity discharge lamp 10, which is generally known in the art. The high intensity discharge lamp 10 has a glass tube or light-transmissive envelope 12, which has a circular cross-section, and includes electrodes 14, lead rods 16, foil(s) 18. The envelope 12 is hermetically sealed at both ends by bases 24, and is pinched at section 26 to maintain the connector assembly intact. The envelope is filled with a conventional fill gas, and the electrodes draw on an exterior power source, not shown, to produce an arc discharge.

Figure 2:
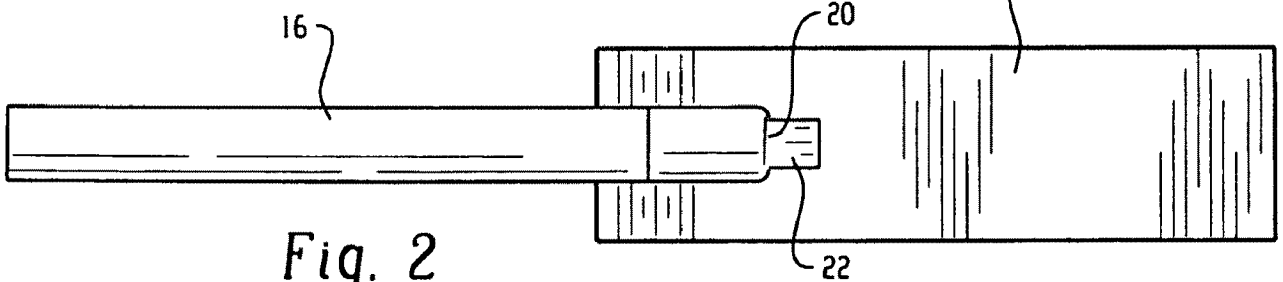
Fig. 2 PRIOR ART
FIG. 2 is a diagram of a prior art connection between a lead and a foil.
Figure 2A:
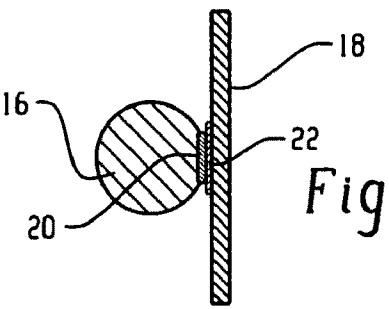
FIG. 2A is a diagram of a cross-section of the connection of FIG. 2.

FIG. 2 is a diagram of the outer lead/foil assembly of a prior art lamp. The diagram shows the conventional outer lead 16, substantially round in diameter, and a flat foil 18. At the point of connection, there is generally a weld joint 20 connecting the lead and the foil. In addition, it has been known to add a tab 22 to increase the strength of the weld. As can be appreciated, even with tab 22, because the lead is substantially round and the foil substantially flat, and because the foil width is greater than that of the lead, the connection between the two is tangential. This is depicted more clearly in FIG. 2A, which shows a cross-sectional view of the lead 16/foil 18 assembly at the weld joint 20. Due to the tangential nature of weld joint 20, extremes in heat and energy can quickly weaken the weld joint leading to failure thereof. Consequently, the lamp as a whole will also fail due to loss of electrical continuity.

Figure 3:
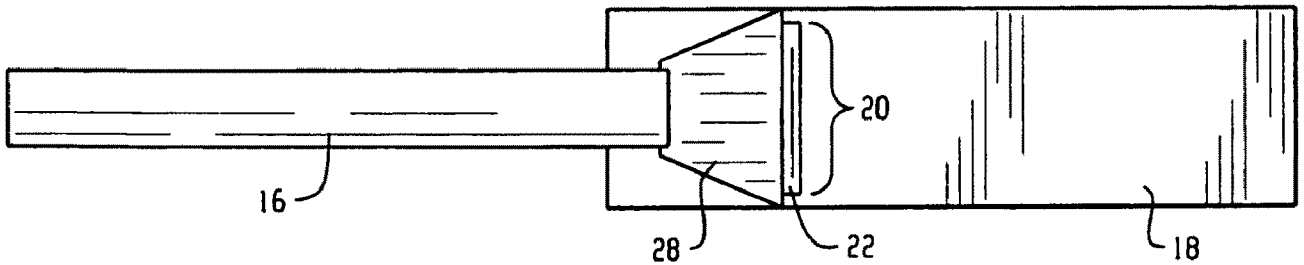
FIG. 3 is a diagram of a lead/foil assembly according to the invention.

A lead-foil assembly in keeping with this disclosure is set forth in FIG. 3. As in the FIG. 2 prior art assembly, the inventive assembly includes lead 16, which is generally tubular in shape, and foil 18, which is flat or planar and has a width greater than that of the lead, and possibly up to three or more times the width of the lead. That end of lead 16 which is welded to foil 18 is encompassed by connector 28. The connector 28 has a geometric shape such that the portion which encompasses lead 16 fits over or around the end thereof and is intimate contact with lead 16 and is, therefore, barely larger than the width of lead 16. Connector 28 then tapers outwardly toward the opposite end of the connector where it exhibits a width greater than lead 16 and up to the width of foil 18. At its widest end, connector 28 may have any geometric shape, so long as one surface or side of the shape is planar. This planar side is the location of the weld joint 20 between lead 16 and foil 18 in this inventive disclosure. While in FIG. 2 and FIG. 2A the weld joint 20 is merely tangential, in the current lead/foil assembly, the weld joint 20 extends substantially the full width of foil 18 along a planar surface of connector 28. As can be seen, the contact surface area of the weld joint 20 is increased over that of the prior art. In addition, the connector functions to dissipate excess energy that may enter the lamp through lead 16. Therefore, connector 28 increases the strength of weld joint 20 and enhances thermal performance of weld joint 20 and the lead/foil assembly. As is shown in FIG. 3, a tab 22 may still be employed as in the prior art design, though it is not necessary.

The tapered configuration of the connector shown in FIG. 3 enhances the flow of the quartz glass around the weld joint area of the assembly, reducing the likelihood of shaling. As has been noted, connector 28 at the weld joint end thereof may have any geometric shape, as long as at least one surface thereof is planar. For example, the connector may be square, rectangular, pentagonal, hexagonal, or octagonal, or may have a portion thereof that is spherical in nature, so long as it has at least one planar surface for use in connecting the lead to the foil at the weld joint.

Figure 4:
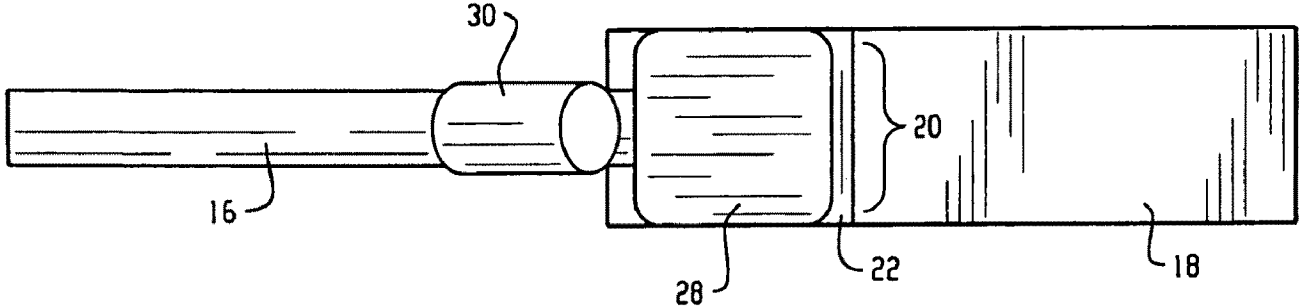
FIG. 4 is a diagram of a lead/foil assembly according to the invention.

Another example of the lead/foil assembly according to the invention is set forth in FIG. 4. In this embodiment, lead 16 is again encompassed at the weld joint 20 end thereof by a connector 28. The connector does not exhibit a tapered configuration as in FIG. 3, but has a contact surface area for the weld joint 20 of substantially the full width of foil 18. This FIG. 4 further sets forth the addition to the assembly of a coil, usually of tungsten, as is known in the prior art.

Figure 5:
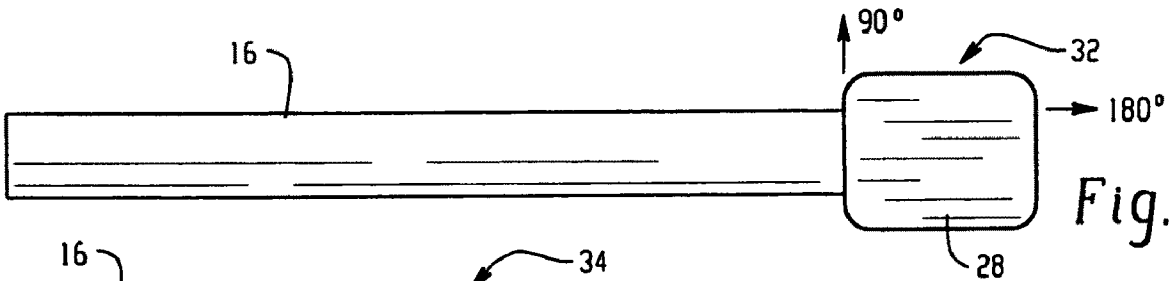
FIG. 5 is a diagram of a lead/foil assembly according to the invention.

FIG. 5 is a diagram of lead 16 and connector 28. In this diagram, lead 16 has a diameter of about 1 mm. Connector 28 has a width of about 3 times that of lead 16, or 3 mm. In addition, this FIG. sets forth the angle of possible taper 32 for the connector from the lead to the weld joint. As is seen, connector 28 may exhibit no taper, represented by an angle of 90°, as in the case of FIGS. 4 and 5, and may be tapered up to as much as 180°, though this would represent a connector with a width substantially that of lead 16. It is preferable, for purposes of contact surface area and heat dissipation, that the taper fall somewhere between 90° and 180°.

Figure 6:
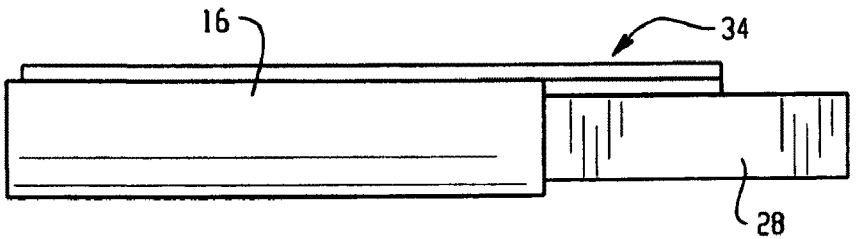
FIG. 6 is a diagram of a lead/foil assembly according to the invention.

Now with respect to FIG. 6, yet another possible embodiment of the invention is shown. In this FIG. 6, lead 16 is shown as having a diameter greater than that of connector 28. Also provided is a conductive coating 34, which covers at least the connector, but may extend to cover all or some of the lead or foil as well. The conductive coating 34 may be a conductive emissive coating, comprising a conductive material that will not hinder light emission of the lamp, such as aluminum. The coating may further include a metal oxide component, including but not limited to, for example, zinc oxide, zirconium oxide, indium oxide, or oxides, or combinations thereof. The coating may be applied by any known technique, such as sputtering, electron beam deposition, or other known processes. The coating is applied to strengthen the weld joint area of the assembly as well as to aid in the dissipation of excess heat. The conductive emissive coating, if it is not deposited on the lead/connector assembly, may be deposited directly to the inner or exterior surface of the lamp to aid in heat dissipation.

The lead 16 may include outer lead rods, which transfer energy from an external source to the lamp interior, as is shown in FIG. 1, or inner lead rods, or electrodes 14 as in FIG. 1. The foregoing disclosure is applicable to either type of lead, inner or outer, as a connection must be established for both types of leads to the foil. The leads are generally formed from a refractory metal, as is the foil. For example, the foil may comprise molybdenum, though other materials may be substituted therefore.

Figure 7:
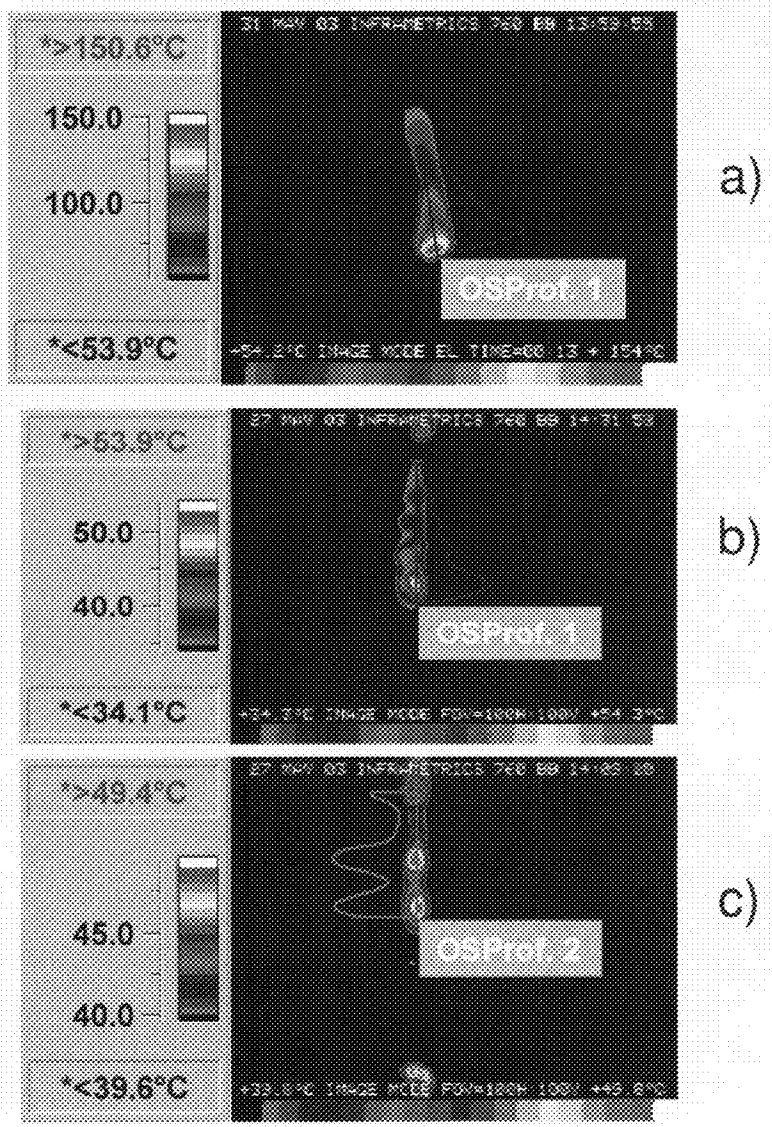
FIGS. 7*a-d* is a thermal profile for prior art weld structures as compared to that according to the invention.
Figure 7D:
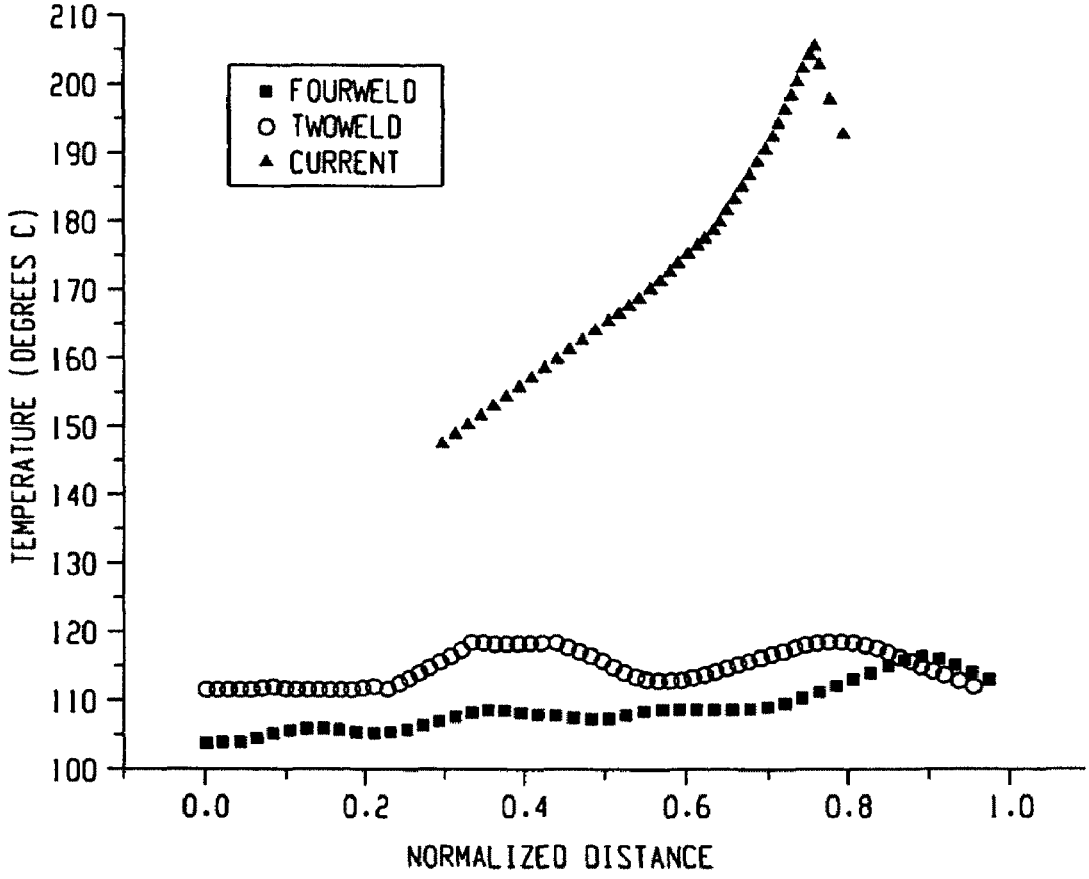

With reference now to FIGS. 7*a-d*, there is provided a series of thermal profiles. The profiles are infrared thermal profiles for typical current weld structures as compared to that of the improved weld structure of the invention. FIG. 7*d* shows a thermal profile summary for a normalized distance, which is the same for the overall profile. Since the lamp can operate between about 6 to 15 amps, the proof of concept is shown for the lowest current at which justification is seen for the fact that a greater advantage can be found at higher currents. FIG. 7*a* sets forth an infrared thermal profile for a current or known lamp. As is seen, the temperature gradient and temperature is greater than 200° C. The red portion in a single place corresponds to localized heating which can lead to connector failure due to thermal stress and oxidation of the connector material. This is magnified in those situations where the current fluctuates, as in some less developed countries. Greater contact area, however, would enhance current flow and decrease resistive heating. Note FIG. 7*b*, where the 4 consecutive welds demonstrates a drastically reduced temperature, though there is still some gradient as shown in FIG. 7*d*. FIG. 7*c* sets forth a 2 weld, or a spot weld, performed at a distance of 1 mm apart. The temperature drop is as good as for the 4 weld while the temperature gradient is much less that for the 1 and 4 welds. FIG. 7*d* supports a conclusion that double is the best conducting path, because it reduces the temperature gradient of the connector assembly and allows the lamp to run cooler over all.

The invention has been described with reference to the preferred embodiments. Obviously, modifications and alterations will occur to others upon reading and understanding the preceding detailed description. It is intended that the invention be construed as including all such modifications and alterations.

What is claimed is:

1. A discharge lamp comprising:

a discharge envelope containing a discharge-supporting fill;

at least one pair of inner leads having at least a portion extending into the envelope and between which an electric discharge passes during operation of the lamp;

for each inner lead, a corresponding outer lead passing through an end of the envelope;

a substantially planar foil between a pair of corresponding inner and outer leads for creating an electrical connection there between; and a separate connector provided between any one lead and the substantially planar foil, the connector being attached to the lead and welded to the substantially planar foil such that a weld joint connecting the connector and the foil extends along substantially the entire width of the foil for preventing failure thereof during conditions of extreme heat and energy and fixedly secured to any one lead, the connector providing a planar contact surface and increasing a contact surface area and providing means for dissipating excess heat and energy entering the lamp through the lead.

2. The lamp of claim 1 wherein the lamp is a high intensity discharge lamp.

3. The lamp of claim 1 wherein the inner leads comprise electrodes.

4. The lamp of claim 1 wherein the outer lead comprises a refractory metal rod.

5. The lamp of claim 1 wherein the substantially planar foil is a refractory metal foil.

6. The lamp of claim 1 wherein the connector has a first end that fits intimately around the end of the lead and a second end having a larger perimeter than the first end and at least one planar side, the at least one planar side having a width up to the width of the foil.

7. The lamp of claim 6 wherein the connector has a polygonal shape at its second end and is tapered from smaller at the first end to larger at the second end.

8. The lamp of claim 1 further including a tab for increasing the strength of the weld joint between any one lead and the foil, the tab extending from the connector to the foil.

9. The lamp of claim 1 further comprising a coating of at least partially conductive material over at least the connector.

10. The lamp of claim 9 wherein the conductive material comprises at least aluminum and hafnium.

11. The lamp of claim 10 wherein the coating further comprises at least one additional metal oxide.

12. The lamp of claim 11 wherein the at least one metal oxide is selected from indium oxide, zirconium oxide, zinc oxide and a combination thereof.

13. A discharge lamp comprising:

an envelope containing a discharge-supporting fill;

first and second inner leads each having at least a portion extending into the envelope and between which an electric discharge passes during operation of the lamp;

corresponding first and second outer leads passing through the envelope, and forming first and second pairs of lead assemblies with the respective first and second inner leads;

a substantially planar foil between the inner lead and the outer lead of the first lead assembly; and a separate connector welded to any one lead and the substantially planar foil of the first lead assembly, the connector having a first end attached to an end of the lead, and a second end located entirely on the foil such that a weld joint connecting the second end and the foil extends along substantially the entire width of the foil for preventing failure thereof during conditions of extreme heat and energy, the connector increasing a contact surface area and thereby dissipating excess heat and energy entering the lamp through the lead.

14. The lamp of claim 13 wherein the second end includes at least one planar portion having a width approximately equal to a width of the foil.

15. The lamp of claim 13 wherein the connector has a polygonal shape at the second end.

16. The lamp of claim 13 wherein the connector has a generally tapered conformation from the first end to the second end, and wherein the first end of the connector is smaller than the second end of the connector.

17. A high intensity discharge lamp comprising:

a discharge envelope containing a discharge-supporting fill;

at least one pair of inner leads having at least a portion extending into the envelope and between which an electric discharge passes during operation of the lamp;

for each inner lead, a corresponding outer lead passing through an end of the envelope;

a substantially planar foil between a pair of corresponding inner and outer leads for creating an electrical connection there between;

a weld joint connecting the inner lead and the substantially planar foil and the outer lead and the substantially planar foil;

a separate connector provided between the inner lead and the substantially planar foil and the outer lead and the substantially planar foil, at least a portion of connector being bounded by a perimeter of the foil, the connector having a planar contact surface and increasing a contact surface area and providing means for dissipating excess heat and energy entering the lamp through the lead; and the weld joint extending substantially the full width of the foil along the planar contact surface of the connector for preventing failure thereof during conditions of extreme heat and energy.

18. The lamp of claim 17 wherein the planar contact surface of the connector has a width approximately equal to the width of the foil.

19. The lamp of claim 17 wherein the connector includes a sloping surface extending from the lead to the foil, the sloping surface being located entirely within the perimeter of the foil.

* * * * *